US008141282B2

(12) United States Patent
Goodfellow et al.

(10) Patent No.: US 8,141,282 B2
(45) Date of Patent: Mar. 27, 2012

(54) FILING DEVICE WITH RETRACTABLE TABS

(75) Inventors: Andrew Goodfellow, Phoenix, AZ (US); Christopher Holman, Mesa, AZ (US); Braden Jones, Phoenix, AZ (US)

(73) Assignee: Esselte Corporation, Melville, NY (US)

( * ) Notice: Subject to any disclaimer, the term of this patent is extended or adjusted under 35 U.S.C. 154(b) by 6 days.

(21) Appl. No.: 12/015,349

(22) Filed: Jan. 16, 2008

(65) Prior Publication Data

US 2009/0178320 A1 Jul. 16, 2009

(51) Int. Cl.
*G09F 23/10* (2006.01)

(52) U.S. Cl. ..... 40/641; 40/360

(58) Field of Classification Search ..... 40/641; 116/327, 321; 229/67.2
See application file for complete search history.

(56) References Cited

U.S. PATENT DOCUMENTS

| | | | | |
|---|---|---|---|---|
| 626,901 | A | 6/1899 | Gilman | |
| 958,050 | A | 5/1910 | Whipple | |
| 1,048,577 | A * | 12/1912 | Pardoe | 40/359 |
| 1,697,985 | A | 9/1926 | Lindsay | |
| 1,711,895 | A | 1/1927 | Lehman et al. | |
| 1,688,965 | A | 3/1927 | Heiland | |
| 2,260,407 | A | 10/1941 | Schade | 129/1 |
| 2,300,623 | A * | 11/1942 | Hornung | 40/360 |
| 3,132,628 | A | 5/1964 | Gehlsen | 116/132 |
| 3,747,242 | A | 7/1973 | Heimann | 40/2 R |
| 4,184,699 | A | 1/1980 | Lowe, Jr. | 281/41 |
| 4,255,888 | A * | 3/1981 | Bastogne | 40/359 |
| 4,318,236 | A | 3/1982 | Giulini | 40/360 |
| 4,905,393 | A | 3/1990 | Laurie | 40/641 |
| 5,311,685 | A | 5/1994 | Wyant | |
| 5,341,982 | A | 8/1994 | Syers | 229/1.5 R |
| 5,540,513 | A | 7/1996 | Wyant | |
| 5,876,817 | A | 3/1999 | Mathna et al. | 428/40.1 |
| 5,996,881 | A | 12/1999 | Smith | 229/67.1 |
| 6,332,285 | B1 | 12/2001 | Aaldenberg et al. | 40/641 |
| 6,732,461 | B2 | 5/2004 | Slattery et al. | 40/641 |
| 6,883,460 | B2 * | 4/2005 | Weisenfeld | 116/313 |
| 6,928,761 | B2 | 8/2005 | Frappell | 40/641 |
| 6,976,449 | B2 * | 12/2005 | Weisenfeld | 116/319 |
| 7,025,382 | B2 | 4/2006 | Wiggins | 283/36 |
| 7,040,051 | B2 | 5/2006 | Windorski | 40/641 |
| 7,055,862 | B2 | 6/2006 | Viby | 283/81 |
| 7,610,707 | B1 * | 11/2009 | Payne | 40/641 |
| 7,628,426 | B1 * | 12/2009 | Rowe et al. | 281/29 |
| 2001/0002751 | A1 | 6/2001 | Bauman et al. | 283/36 |

(Continued)

FOREIGN PATENT DOCUMENTS

GB 2342320 4/2000

OTHER PUBLICATIONS

International Search Report and Written Opinion dated Aug. 10, 2009 for International Application No. PCT/US2009/030854.

*Primary Examiner* — Joanne Silbermann
*Assistant Examiner* — Kristina N Junge
(74) *Attorney, Agent, or Firm* — Dorsey & Whitney LLP

(57) ABSTRACT

A filing device having retractable tabs is disclosed. The tabs are movable between a retracted position and an extended position, such as to selectively position tabs that are extended along an edge of a folder or divider.

36 Claims, 4 Drawing Sheets

U.S. PATENT DOCUMENTS

| | | | | |
|---|---|---|---|---|
| 2003/0074817 | A1 | 4/2003 | Saylor | 40/360 |
| 2003/0126779 | A1 | 7/2003 | Sato et al. | 40/641 |
| 2005/0077720 | A1 | 4/2005 | Yamamoto et al. | |
| 2005/0193608 | A1 | 9/2005 | Flynn et al. | 40/638 |
| 2005/0238821 | A1 | 10/2005 | Ham | 428/1.2 |
| 2005/0257408 | A1 | 11/2005 | Black | 40/641 |
| 2006/0000134 | A1 | 1/2006 | Windorski | 40/641 |
| 2006/0242869 | A1 * | 11/2006 | Bunger et al. | 40/359 |
| 2007/0119082 | A1 | 5/2007 | Gilchrist | |
| 2007/0234601 | A1 | 10/2007 | Yoo et al. | |

* cited by examiner

FILING DEVICE WITH RETRACTABLE TABS

FIELD OF INVENTION

The present invention relates to a filing device and more particularly to a filing device having a retractable tab.

BACKGROUND OF THE INVENTION

File folders having tabs extending from an edge of the folder are known. Tabs can be formed integrally with the folder such that they are permanent extensions of the folder, or provided as separate members that can be attached to the folder.

It is also known to provide movable tabs on folders. For example, U.S. Pat. No. 5,996,881 discloses a convertible folder with a tab that is secured to a pair of elongate slots such that it is movable up and down the slots between a display position and an out-of-way position. The top portion of the tab is substantially wider than the distance between the slots such that the top portion remains protruding on top of and out of plane from the folder in the out-of-way position. U.S. Pat. No. 5,341,982 discloses file folder having a tab that is placed at an outer corner of the folder. The tab is secured to the folder by a rivet such that it can be rotated 90° to extend from either edge of the corner. U.S. Publication No. 2007/0119082 discloses a folder tab that includes a fixed base and a movable title portion, such that the title portion can be raised and lowered within the base. The title portion remains protruding from the folder even in the lowered position.

There is a need for a filing system having improved retractable tabs.

SUMMARY OF THE INVENTION

The invention relates to a filing system and components thereof, i.e., filing devices such as folders, binders, or dividers, having retractable tabs. The filing device comprises a first panel having a first edge and a tab holder disposed proximate the edge of the panel. The tab holder is configured for receiving and retaining a tab therein and defines at least one opening. In an embodiment, the tab holder comprises tab holding members that are configured to cooperatively hold a tab between adjacent members. The tab holder can be configured for holding any suitable number of tabs.

The filing device includes a retractable tab having a display portion and a mounting portion. The mounting portion is mounted in the tab holder such that the tab is movable between a retracted position, in which the display portion is disposed substantially in plane with the panel and tab holder, and an extended position, in which the display portion extends from the tab opening beyond the first edge of the panel and an extended position and wherein the tab holder is associated with the mounting portion to retain the mounting portion from being released therefrom. The mounting portion is preferably wider than the tab opening for preventing the tab from being removed from the tab holder.

Preferably, the display portion extends substantially no further than first edge of the panel in the retracted position. For example, the tab can have substantially the same height as the tab holder such that the uppermost edge of the tab is generally flush with the first edge in the retracted position.

In an embodiment, the tab can be retained in the extended position by friction against moving to the retracted position. In such embodiment, the display portion can be configured to be no wider than the opening of the tab holder such that the display portion can slide into and out of the opening. Alternatively, the display portion can be wider than the tab opening for retaining the tab in the extended position, the display portion being resiliently deformable for fitting through the opening when moved between the retracted and extended positions.

The display portion can include locking members, such as projections or protrusions, for reversibly engaging the tab holder in the extended and/or retracted positions. Such locking members "lock" the tab in place, preferably by audibly and/or tactilely snapping into place, so that the tab does not freely slide into and out of the tab holder.

For example, the display portion can be wider than the tab opening in a lateral direction measured along the panel edge to provide locking members for retaining the tab in the extended and retracted positions. The display portion can include lateral protrusions, and the tab can further define notches between the protrusions and the mounting portion for receiving lateral edges of the tab holder at the opening when the tab is in the extended position.

Alternatively or additionally, the display portion can extend out of plane with respect to the panel for retaining the tab in the extended position. The display portion can be resiliently biased with respect to the mounting portion for bending out of plane with respect to the panel for resisting retraction from the extended position, or resiliently biased out of plane for increasing friction against the tab holder in the retracted position that resists movement of the tab toward the extended position.

In a further embodiment, the tab can comprise one or more stiffening members that extend from the display portion proximate the mounting portion to further retain the tab in the selected position.

The filing device can include a plurality of tab holders disposed along the panel edge and a plurality of retractable tabs associated with the tab holders for selectively extending at least one of the display portions at a desired location along the panel edge. Further a plurality of such filing devices can be provided in a filing system, such that different ones of the devices can selectively have the tabs in the extended positions at different locations along the panel edges for organizing the filing system.

BRIEF DESCRIPTION OF THE DRAWINGS

The invention will be better understood with reference to the attached drawings illustrating preferred embodiments, wherein.

DETAILED DESCRIPTION OF THE PREFERRED EMBODIMENTS

While the present retractable tabs are described in connection with folders in the following description, it will be appreciated that any suitable filing device, such as binders, dividers, index cards, notebooks, and the like, can include the retractable tabs according to the invention. Preferably, the tabs are employed on an article that holds or divides a stack or stacks of paper. Further, a plurality of same or different types of filing devices with retractable tabs can be included in a filing system, such that different ones of the devices can selectively have tabs extended at different positions along the edges thereof for organizing the filing system.

Figure 1:
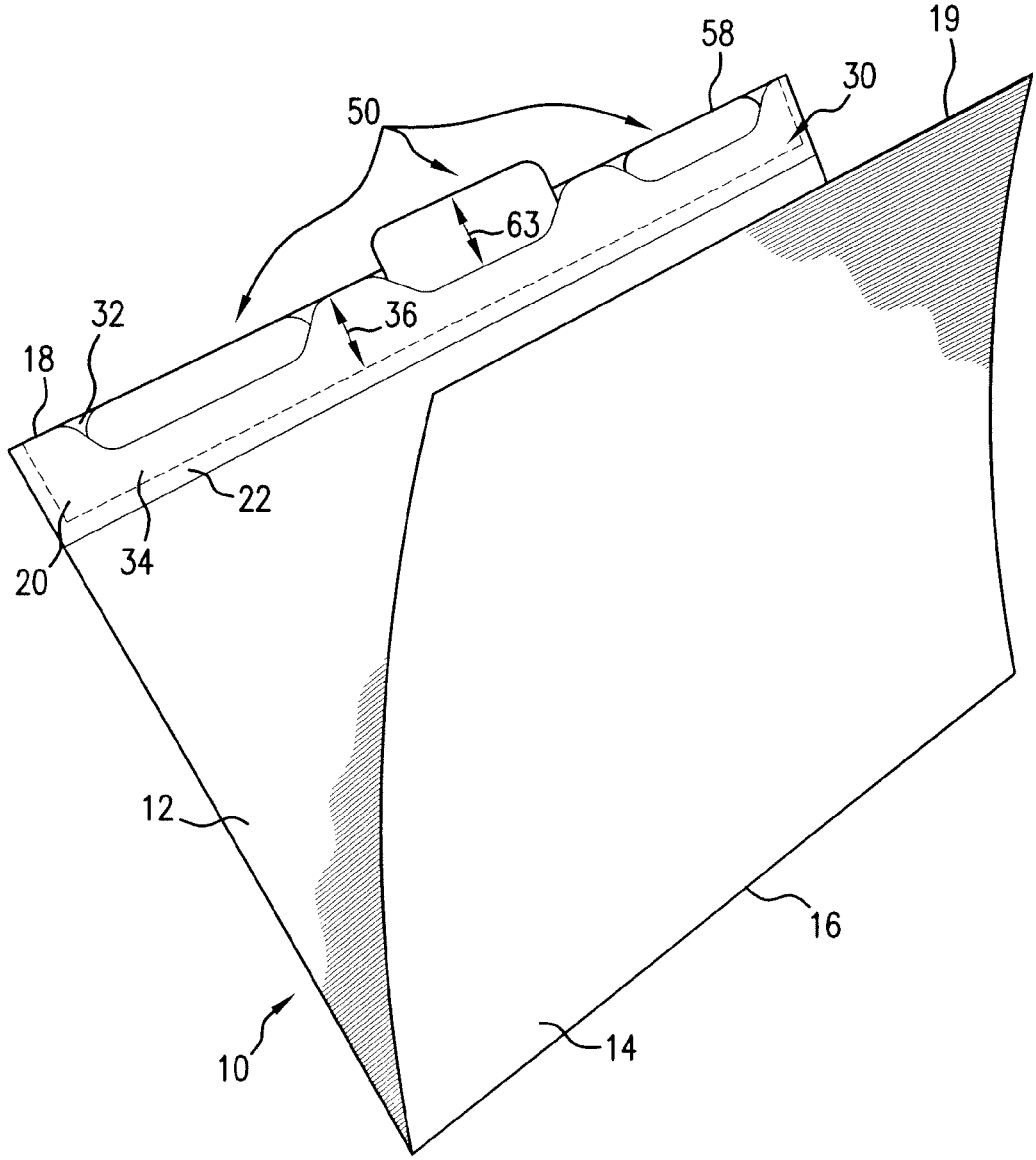
FIGS. 1 and 2 are perspective views of a folder and retractable tabs constructed according to an embodiment of the invention.
Figure 2:
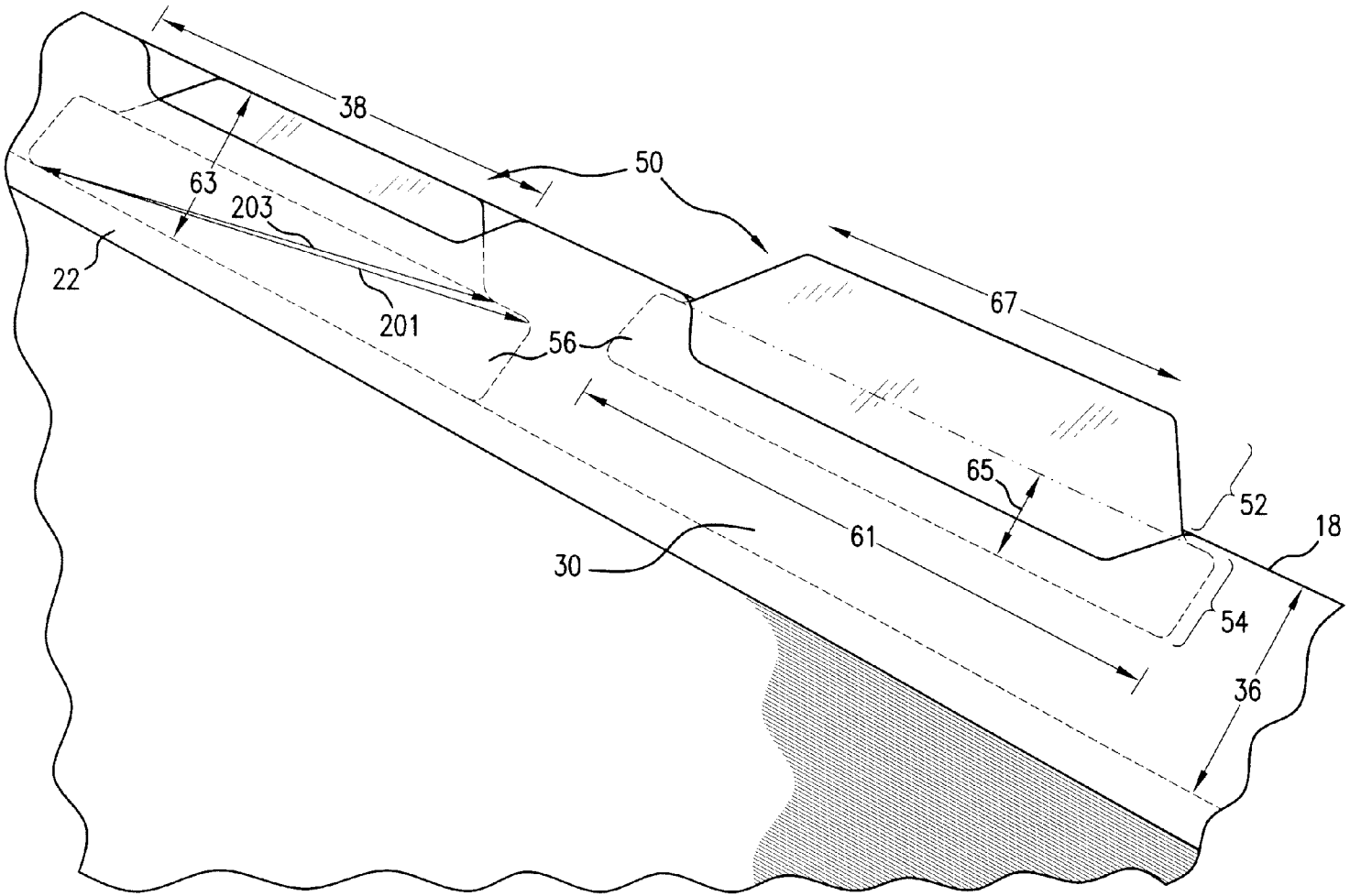

Referring to FIGS. 1 and 2, a folder 10 having retractable tabs 50 is shown. The folder 10 includes a pair of flat cover panels 12,14 that are preferably rectangular. The folder 10 can have any suitable size and shape, and can be made of any suitable material. For example, the folder 10 can have a conventional file folder size and can be formed from a single blank of substantially rectangular paperboard material that is folded along a fold line 16 to hingedly define the panels 12,14, such that the panels 12,14 are interconnected to each other along the fold line 16.

The folder 10 includes one or more tab holders 30 proximate an edge of the folder 10, such as the edge disposed opposite from the spine 16 that hingedly connects the cover panels 12,14. Tab holders can also be provided at the opposite edge 19, such that the folder 10 includes tab holders on both panels 12,14. The tab holder 30 includes one or more openings 32 into which tabs can be provided. The tab holder 30 can include a single unit that extends substantially the entire edge 18, or can include multiple tab holding units positioned along the edge 18.

In a preferred embodiment, the tab holder 30 is formed by folding an edge portion 20 of the panel 12 and adhesively securing the folded portion 20 to preferably the interior of the panel 12. In other embodiments, separate tab holder structures can be attached to the folder 10, for example by gluing. The tab holder 30 preferably does not add significantly thickness or bulk of the folder 10. Only a portion of the folded portion 20, such as the peripheral edge 22, is preferably adhesively attached to the panel 12 such that the unattached folded portion and the panel 12 form a tab holding cavity 34 therebetween. In other embodiments, other portions of the folded portion 20, such as between openings 32, can be attached to the panel 12, to separate individual cavities 34. The cavity 34 is dimensioned to receive the tab 50 therein. Preferably, the height 36 of the cavity 34 substantially corresponds to the height 63 of the tab 50. In other embodiments, the height 36 of the cavity 34 can be greater or less than the height 63 of the tab 50.

A tab opening 32 for receiving the tab 50, such as a slot, is defined in the tab holder 30, for example by removing a portion of the folded portion 20 and/or panel 12 proximate the edge 18. The openings 32 can be formed by removing a portion of either the folded portion 20 or panel 12 or both. The opening can be formed before or after the folded portion 20 and panel 12 are attached.

Figure 3:
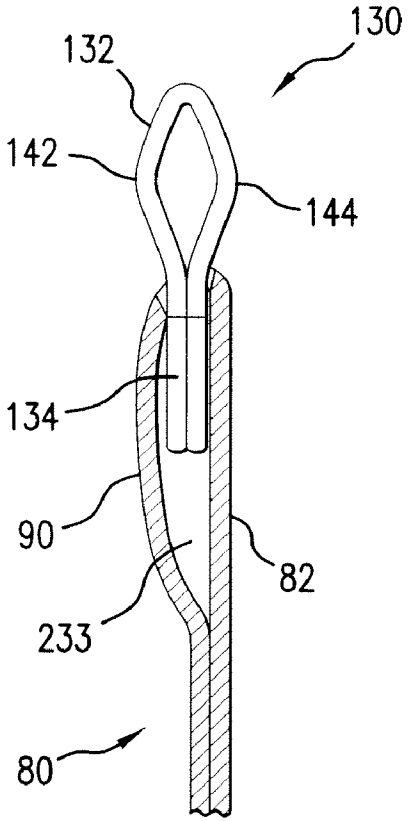
FIG. 3 is a side view of a folder and a retractable tab constructed according to another embodiment of the invention.

The opening 32 is preferably sized and configured to facilitate grasping of the tab 50 therein by hand to extend the tab 50. The opening can have any suitable configuration, such as trapezoidal configuration shown in FIGS. 1-2, rectangular configurations as shown in FIGS. 3-4, or other configurations such as curved configurations. The folder 10 can include any suitable number of openings. For example, the number of openings can be selected based on the desired folder and tab configuration and sizes of the folder and tabs. A conventional manila folder or a hanging folder having a width of about 12 to 15 inches can include 1 to 7 openings along an edge of the folder, preferably 2 to 5 openings, and more preferably 3 or 4 openings, for holding the corresponding number of retractable tabs. If smaller tabs are used, more openings and retractable tabs are also possible. When the folder 10 includes multiple openings 32, the openings 32 are preferably separated by a suitable distance such that adjacent tabs 50 do not contact each other. In an example, adjacent ends of adjacent openings are separated by at least about 1 inch. Preferably, adjacent openings are separated by between about 1 to 4 inches.

The tab 50 is configured to be movable between a retracted position, wherein the tab 50 does not extend beyond the edge 18 of the folder 10, as shown by the far right tab in FIG. 1, and an extended position, wherein the tab 50 extends beyond the edge 18, as shown by the middle tab in FIG. 1. In the retracted position, the top edge 58 of the tab 50 is preferably generally flush with or is below the edge 18. In this way, the tab 50 is hidden from view by the facing cover 14 when the folder 10 is closed, or does not optically break the visual edge of panel 12. The tab 50 is movable between the retracted and extended positions by sliding it upwardly and downwardly within the tab holder 30, such as by pulling and pushing by hand. When the tab 50 is pulled or pushed to a height, the tab 50 remains in that position due to the fraction fit between the tab 50 and the tab holder 30. Thus, the tab 50 can be moved to any desired height, confined only by the height 36 of the tab holder 30.

The tab 50 comprises a display portion 52 and a mounting portion 54. The mounting portion 54 is configured to be received in the opening 32, and retained within the tab holder 30. In an embodiment, the mounting portion 54 includes side flanges 56. When the tab 50 is pulled out into the fully extended position, the side flanges 56 abut against the closed portion of the edge 18 to prevent the tab 50 from slipping out of the opening 32. Thus, the tab can be pulled up until the side flanges 56 contact the edge 18 and pushed down until the mounting portion 54 contacts the bottom of the tab holding cavity 36. Preferably, the depth 36 of cavity 34 is sufficiently small and the height 65 and width 61 of the flanges 56 are configured to prevent the tab 50 from being twisted out of the opening 32 without bending, to help avoid unintended removal of the mounting portion 56 from the opening 32.

The display portion 52 can have any suitable width 67, which can be selected based on, for example, the size of the particular filing system, size of the opening of the tab holder, and desired use. For a conventional manila folder or hanging folder of a width up to about 15 inches, the display portion 52 can have a width 67 of preferably at least about a quarter inch, more preferably at least about a half inch, and still more preferably at least about 1 inch, and at most about 12 inches, preferably at most about 10 inches. In preferred examples, the width 67 is about 1 to 3 or 5 inches.

Preferably, the width 61 of the mounting portion 54 is wider than the width 38 of the opening 32. For example, the width 61 can be at least about a quarter or third of an inch and preferably at least about a half inch wider than the width 38 of the opening 32. The width 61 is at most about 3 inches and preferably at most about 2 inches wider than the width 38 of the opening 32. In a preferred example, the width 61 is about a half to 1 inch wider than the width 38 of the opening 32. The height 63 of the tab 50 is preferably no wider than the height 36 of the tab holding cavity 34, and more preferably substantially corresponds to the height 36 of the cavity 34. The tab 50 preferably has a height 63 of at least about a half inch, more preferably at least about ¾ inches, and at most about 3 inches, more preferably at most about 2 inches. In preferred examples, the tab has a height of about ¾ to 2 inches. Preferably, the height 65 of the flange 56 and the height 63 of the tab 50 has a ratio of about 1:10 to about 7:10, and more preferably about 1:5 to 1:2. Other suitable dimensions can be used in alternative embodiments.

The mounting portion 54 preferably has sufficient width 61 and height 65 to prevent the tab 50 from being removed from the tab holder 30 by merely twisting the tab within the tab holder without deforming the tab, for example by flexing the side flanges 56 toward each other. In the embodiment shown in FIG. 2, the diagonal distance 201 of the mounting portion 54 is sufficiently greater than the diagonal distance 203, so that the tab 50 can be inserted into the opening 32 by deforming the tab 50 but cannot be taken out of the tab holder 30 by rotating the tab 50 because flange 56 of the tab 50 will first abut either the lower end or upper end of the height 36 of the cavity 34 and block further rotation.

The display portion 52 is configured to be at least partially received in the opening 32 in the retracted position and to extend beyond the edge 18 in the extended position. Preferably, the display portion 52 is sized and configured for sliding into and out of the opening 32 by pushing and pulling by hand. In preferred embodiments, the display portion 52 is no wider than the width 38 of the opening 32 so that it can slide in and out of the opening 32 with ease. For example, the display portion 58 can have a generally rectangular configuration with substantially uniform width as shown in FIG. 1, or can have downwardly inclined side edges as shown in FIG. 2. In other embodiments, at least a portion of the display portion 52 can be wider than the opening 32 for retaining the tab 50 in the extended position. In such embodiments, the display portion can be resiliently deformable for fitting through the opening 32 when moved between the retracted and extended positions.

Preferably, the display portion and the mounting portion are substantially continuous as shown in FIGS. 1 and 2, i.e., extends from one to the other without any visible division or disruption therebetween.

Figure 4B:
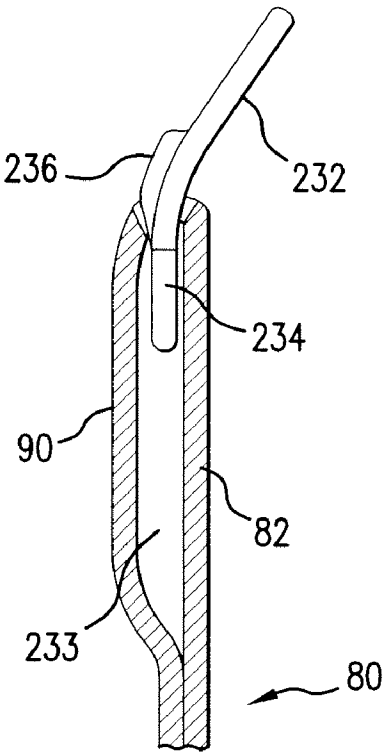
FIGS. 4A and 4B are perspective and side views of a folder and a retractable tab constructed according to another embodiment of the invention.
Figure 4A:
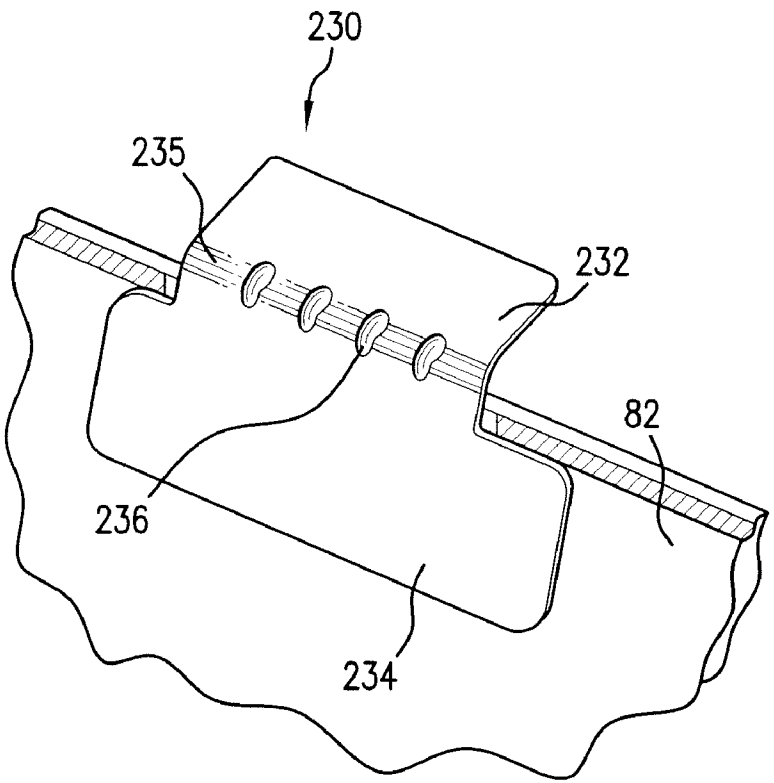
Figure 5:
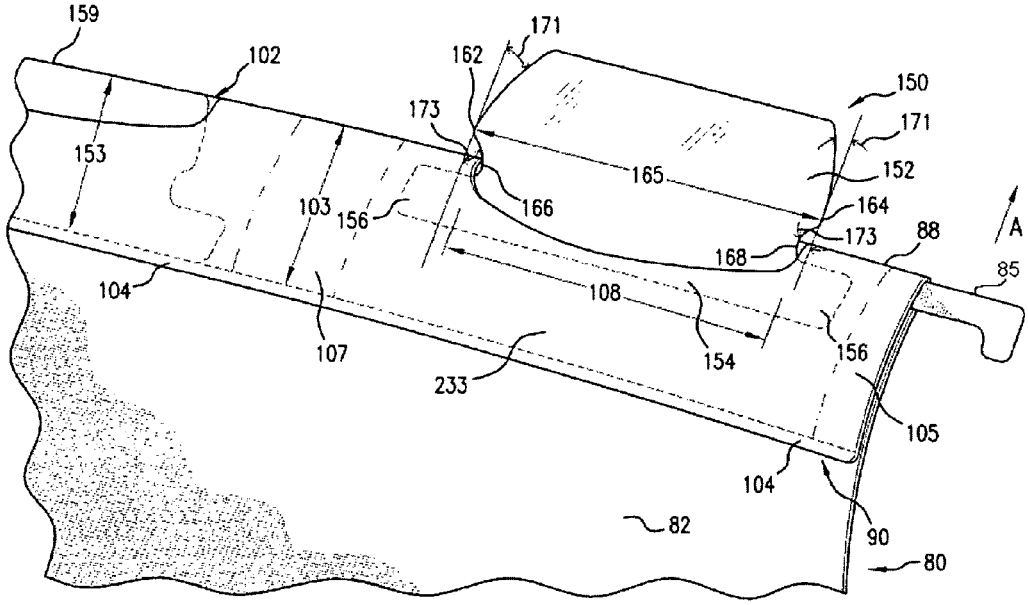
FIG. 5 is a perspective view of a folder and retractable tabs according another embodiment of the invention.

Referring to FIGS. 3-5, a hanging folder 80 having retractable tabs 130, 230, 150 is shown. Similar to folder 10, folder 80 can have any suitable size and shape. Preferably, the folder 80 includes a pair of flat, generally rectangular folder panels that are formed from a single blank of substantially rectangular paperboard material and are interconnected to each other along a fold line. The embodiment of the folder 80 shown in FIG. 5 has a hanging bar 250 with a hooked end 252. The hanging bar 250 is shown protruding from and disposed within the cavity 233 extending across the tab holder 90 and first panel 82. The hooked end 252 protrudes out of the cavity 233 of the first panel 82.

The folder 80 shown in FIGS. 3-5 includes one or more tab holders 90 that have a similar configuration as the tab holder 30 shown in FIGS. 1-2 and define a tab holder cavity 233. For example, the tab holder 90 can be formed by folding an edge portion of the panel 82 over itself and attaching the bottom edge 104 of the folded portion to the interior of the panel 82. Optionally, lateral edges of the folded portion 105 and the area 107 between openings 102 can also be attached to the panel 82. Preferably, the cavity 233 has a height 103 that is at least as high as the height 153 of the tab 150, such that the uppermost edge 159 of the tab is generally flush with or is lower than the edge 88 of the folder 80 in the retracted position. The opening 102 of the folder 80 is preferably configured such that the tab holder 90 covers at least a portion of, and more preferably substantially the entire, mounting portion 134,234,154. In other embodiments, the opening 102 can extend the entire, or substantially the entire, height of the tab holder 90.

Similar to the tabs 50 shown in FIGS. 1-2, the tabs 130, 230,150 shown in FIGS. 3-5 each comprise a display portion 132,232,152 and a mounting portion 134,234,154, and is mounted on the tab holder 90 such that it is movable between a retracted position and an extended position. The tabs 130, 230,150 can be formed by folding a piece of material over itself to receive an insert, such as a label, therebetween.

In preferred embodiments, the display portion 132,232, 152 comprises locking members to help retain the tab 130, 230,150 in place in the retracted and extended positions, and to prevent the tab 130,230,150 from freely sliding between positions. The locking members reversibly engage with the tab holder 90 in the retracted position, and are released from the tab holder 90 in the extended position to provide a detectible feedback when the tab 130,230,150 is extended or retracted. Preferably, the locking members "lock" the tab in place by audibly and/or tactilely snapping into place, so that the tab does not freely slide into and out of the tab holder. In addition to snapping into place, tactile feedback can also be provided by noticeably changing the force required to continue to move the tab 130,230,150, such as by friction of the tab 130,230,150 against the tab holder 90 that changes depending on the degree of extension or retraction of the tab 130,230,150.

For example, the display portion 132,232,152 can be wider than the tab opening 102,108 in a lateral direction measured along the panel edge 88 to provide locking members for retaining the tab 130,230,150 in the extended and retracted positions. The locking members can comprise lateral protrusions 162,164 shown in FIG. 5, such that the end-to-end distance 165 between the protrusions 162,164 is slightly wider than the width 108 of the opening 102. The distance 165 should preferably be only slightly wider than the width 108, such that the protrusions 162,164 can be inserted into and removed from the tab holder 90 with little force. The user would insert the protrusions 162,164 into the opening 102 by, for example, flexing the edges together. The protrusions 162, 164 are preferably resiliently deformable for fitting through the opening 102 when moved between the extended and retracted positions. When the tab 150 is pulled out to the extended position, the protrusions 162,164 are released and "pop out" from the opening 102. In preferred examples, the distance 165 is at least about 0.1 inches and preferably at least about a quarter inch wider than the width 108, and is at most about 1½ inches and preferably at most about 1 inch wider than the width 108. More preferably, the distance 165 is about a quarter to about a half inch wider than the width 108. When the filing system includes multiple tabs 150 with protrusions 162,164, adjacent tabs 150 are preferably spaced such that protrusions of adjacent tabs do not contact each other.

The tab 150 can additionally include notches 166,168 at either side of the display portion 152, between the protrusions 162,164 and the mounting portion 154, for receiving lateral edges of the tab holder 90 at the opening 102 when the tab 150 is in the extended position. The notches 166,168 thus further facilitate grasping and moving the tab 150 between the extended and retracted positions. The notches 166,168 can be provided with any tab configuration, and are especially advantageous with tabs having lateral protrusions, such as the tab 150 in FIG. 5. The tab holder 90 of FIG. 5 also includes a hanger bar protruding 85 from the lateral sides of tab holder 90.

In preferred embodiments, both the display portion 152 and notches 166,168 are sloped shallowly enough to enable the tab 150 to be pulled or pushed to extend or retract across the tab holder 90 opening without having to bend the tab 150 using fingers. As such, the notches 166,168 also provide a tactile feedback between the retracted and extended positions by snapping or popping into and out of the tab holder 90 when a sufficient force or pressure is exerted thereto to pass them through the opening 102. Besides the notches 166,168, any other suitable features can be used to provide such snapping or popping effect between positions.

Preferably, the display portion 152 and notches 166,168 are sloped at angles 171,173, respectively, with respect to the extension/retraction direction A. The slope 171 of the display portion 152 is preferably at least about 3°, more preferably at least about 5°, and at most about 60°, more preferably at most about 40°, with respect to the extension/retraction direction A. The slope 173 of the notches 166,168 is preferably at least about 5°, more preferably at least about 7°, and at most about 70°, more preferably at most about 50°, with respect to the extension/retraction direction A. In preferred embodiments, the slope 171 is about 5 to 20°, and the slope 173 is about 15 to 45°, with respect to the extension/retraction direction A.

In the embodiment shown in FIG. 3, the tab 130 can have substantially uniform width that substantially corresponds to the width of the opening, and includes locking members that comprise transversely projecting, curved edges 142,144 that extend out of plane with respect to the panel 82 in the extended position to resist retraction of the tab 130 to the retracted position. When the tab 130 is in the retracted position, the projecting edges 142,144 are pressed against the panel 82 by the tab holder 90, and are resiliently biased out of plane for increasing friction against the tab holder 90 that resists movement of the tab 90 toward the extended position. When the tab 130 is pulled out to the extended position, the edges 142,144 "pop out" from the tab holder 90 and extend out of plane with respect to the panel 82 for retaining the tab 130 in the extended position.

In another embodiment shown in FIGS. 4A and 4B, the tab 230 has a display portion 232 that is resiliently biased with respect to the mounting portion 234 for bending out of plane with respect to the panel 82 for resisting retraction from the extended position. Preferably, the display portion 232 is resiliently biased by the tab holder 90 to be substantially within the plane of the panel 82 and contained within the cavity 233 of the tab holder 90 for increasing friction against the tab holder 90 when in the retracted position to resist movement of the tab 230 toward the extended position. The tab 230 can further include one or more stiffening members to help maintain a resilient bend 235, such as stiffening ribs 236, which can be debossed, embossed, or otherwise provided on the display portion 232 proximate mounting portion 234. Preferably, the stiffening ribs 236 extend proximate the intersection between the display portion 232 and mounting portion 234. In each of these embodiments, the tab 130,230 is deformed when retracted to frictionally engage the inside of the tab holder 90 for being retained in the retracted position, and since the display portion 132,232 is out-of-plane, the tab 130,230 would also be retained in place in the extended position.

In this way, the locking members shown in FIGS. 3-5 provide detectible feedback when the tab 130,230,150 is pulled or pushed between extended and retracted positions, or otherwise help retain the tab 130,230,150 in the chosen position. In other embodiments, the tab 130,230,150 can include combinations of locking members, for example, both lateral and transverse protrusions.

The retractable tab according to the invention is preferably sufficiently rigid to resist bending and sufficiently resilient to withstand handling by the user, but is sufficiently flexible to allow insertion into the tab holder. Preferred materials includes paper (e.g., paperboard), lightweight plastic (e.g., thermoplastic such as polypropylene and PVC), and metal. The tab can be configured to be directly written onto, or to hold an insert therein. For example, the tab can comprise two layers of material, such as a piece of material that is folded over itself along an edge thereof, to receive a label therebetween. When configured to hold an insert, the tab should preferably be substantially transparent. The tab can be colored as desired. When the filing system includes multiple tabs, individual tabs can have the same color or different colors.

The tab is preferably formed as a unitary construction, and can be made with conventional equipment, such as conventional die cutters. For example, the tab can comprise a single piece of material. Alternatively, the tab can be formed as two or more layers, for example by folding a piece of material along an edge thereof and joining or otherwise holding together an overlapping portion of the material. In other embodiments, the tab can comprise separate parts, e.g., separate mounting and display portions, that are joined together.

The tab can have any suitable configuration, such as rectangular, trapezoidal, circular, or rounded configurations. The tab can be substantially flat, or can be configured to project out of plane.

The present retractable tabs provide many advantages over conventional tabs. For example, when a filing system includes multiple retractable tabs, the user can easily select and adjust the desired tab configuration by selectively extending and displaying desired number of tabs at desired locations. The tabs are easily moved between extended and retracted positions by pulling and pushing by hand, but are held in place. In embodiments including locking members, the detectible feedback provided by locking members further ensure that the tabs stay in place in the selected position.

As used herein, the term "about" should generally be understood to refer to both the corresponding number and a range of numbers. In addition, all numerical ranges herein should be understood to include each whole integer within the range. While illustrative embodiments of the invention are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present invention.

What is claimed is:

1. A filing device, comprising:

a first cover panel having an edge portion folded to form a folded edge and first and second panel portions on either side of the folded edge, the panel portions being affixed to each other on a first side of the panel portions opposite from the folded edge to form a tab holder and define a cavity between the panel portions, the folded edge defining a second side of the cavity, the cavity being configured for receiving a tab therein, and the tab holder defining a tab opening to the cavity extending along the first side, the first cover panel extending to a cover hinge disposed on an opposite side of the first cover panel from the first side;

a second cover panel pivotally connected to the first cover panel at the cover hinge such that the first and second cover panels cooperatively form a folder; and a retractable tab having a display portion and a mounting portion, the mounting portion being mounted in the tab holder cavity such that the tab is movable between:

a retracted position in which the display portion is disposed substantially in the cavity, and an extended position in which the display portion extends from the cavity through the tab opening beyond the folded edge of the first cover panel, wherein the tab holder is associated with the mounting portion to retain the mounting portion from being released therefrom, wherein a bottom portion of the display portion includes at least one resiliently deformable protrusion and a width that is greater than a width of the tab opening in a lateral direction such that the retractable tab and the tab opening cooperatively act so as to resiliently deform the at least one protrusion during a sliding movement of the retractable tab between the retracted and extended positions.

2. The device of claim 1, wherein the tab holder is configured for retaining the display portion in the retracted position, wherein a top edge of the retractable tab is substantially flush with or below the folded edge of the first cover panel in the retracted position.

3. The device of claim 1, wherein the tab is retained in the extended position by friction against moving to the retracted position, and the display portion extends substantially no further than the folded edge of the first cover panel in the retracted position.

4. The device of claim 1, wherein the mounting portion is wider than the tab opening for preventing the tab from being removed from the tab holder.

5. The device of claim 4, wherein the display portion is resiliently biased with respect to the mounting portion for bending out of plane with respect to the first cover panel for resisting retraction from the extended position.

6. The device of claim 5, wherein the display portion is resiliently biased out of plane for increasing friction against the tab holder in the retracted position that resists movement of the tab toward the extended position.

7. The device of claim 1, wherein the display portion extends out of plane with respect to the first cover panel for retaining the tab in the extended position.

8. The device of claim 7, wherein the tab comprises one or more stiffening members configured for resiliently maintaining a bend in the tab for bending the tab out of plane with respect to the first cover panel in the extended position.

9. The device of claim 1, wherein the display portion includes locking members for retaining the tab in the extended and retracted positions.

10. The device of claim 1, wherein the first cover panel is generally rectangular.

11. The device of claim 1, wherein the device is a divider, or is a folder or binder that further comprises a second cover panel hinged from the first cover panel, wherein the panels are configured as covers.

12. The device of claim 1, wherein the tab holder comprises a plurality of tab holders disposed along the folded edge, and the retractable tab comprises a plurality of retractable tabs associated with the tab holders for selectively extending at least one of the display portions at a desired location along the folded edge.

13. A filing system, comprising a plurality of the devices of claim 12, such that different ones of the devices can selectively have the tabs in the extended positions at different locations along folded edges of first cover panels of the devices for organizing the filing system.

14. The device of claim 1, wherein the filing device is a hanging file, which further comprises a hanging bar having a hooked end, wherein the hanging bar is disposed within the cavity extending across the tab holder and first cover panel, and the hooked end protrudes out of the cavity of the first panel.

15. The device of claim 1, wherein the display portion is slightly larger in at least one dimension than the opening and resiliently and deformably extendible through the opening.

16. The device of claim 15, wherein the display portion is wider than the tab opening in a lateral direction measured along the first edge.

17. The device of claim 16, wherein the display portion has lateral edges tapered from a width wider than the opening to a width that is narrower to the opening on an opposite side from the mounting portion to allow the display portion to be extended through the opening.

18. The device of claim 15, wherein the display portion includes a resiliently biased portion that is bent out of plane with respect to the panel.

19. The device of claim 1, wherein the opening extends along the folded edge.

20. The filing device of claim 1, wherein the width of the tab opening is greater than a width of a top portion of the display portion.

21. A filing device, comprising:

a first cover panel having a first edge, the first cover panel extending to a cover hinge disposed on an opposite side of the first cover panel from the first edge;

a second cover panel pivotally connected to the first cover panel at the cover hinge such that the first and second cover panels cooperatively form a folder;

a tab holder disposed proximate the first edge of the first cover panel, the tab holder configured for receiving and retaining a tab therein and defining a tab opening; and a retractable tab having a display portion and a mounting portion, the mounting portion being mounted in the tab holder such that the tab is movable between:

a retracted position in which the display portion is disposed substantially in the tab holder; and an extended position in which the display portion extends from the tab opening beyond the first edge of the panel, wherein the tab holder is associated with the mounting portion to retain the mounting portion from being released therefrom, wherein the tab comprises a locking member that reversibly engages the tab holder to retain the tab in the retracted and extended positions, and wherein a bottom portion of the display portion includes at least one resiliently deformable protrusion and a width that is greater than a width of the tab opening in a lateral direction such that the retractable tab and the tab opening cooperatively act so as to resiliently deform the at least one protrusion during a sliding movement of the retractable tab between the retracted and extended positions.

22. The device of claim 21, wherein the locking member includes lateral protrusions extending from the display portion such that an end-to-end distance between the protrusions is greater than a lateral width of the opening.

23. The device of claim 22, wherein the tab defines notches between the protrusions and the mounting portion for receiving lateral edges of the tab holder at the opening when the tab is in the extended position.

24. The device of claim 21, wherein the locking member comprises a protrusion biased to extend out of plane with respect to the panel in the extended position to resist retraction of the tab to the retracted position.

25. The device of claim 21, wherein the tab has a height selected such that the display portion is substantially flush with the first edge of the first cover panel in the retracted position.

26. The device of claim 21, wherein the locking member is operably associated with the tab holder to tactilely snap into place when the tab is moved between the extended and retracted positions.

27. The device of claim 21, wherein the tab comprises two layers of material that is folded over itself along an edge thereof to receive a label therebetween.

28. The device of claim 21, wherein the tab holder comprises at least three tab holders disposed along the panel edge, and the retractable tab comprises at least three retractable tabs associated with the tab holders for selectively extending at least one of the display portions at a desired location along the first edge.

29. A filing system, comprising a plurality of the devices of claim 21, wherein the devices are dividers, folders, or binders, such that different ones of the devices can selectively have tabs extended at different positions along the edges thereof for organizing the filing system.

30. The system of claim 29, wherein the system is a folder or binder having two generally rectangular panels interconnected to each other and the system further comprises a tab holder disposed proximate an edge of each panel.

31. The device of claim 21, wherein the tab holder includes front and back panel portions defining a cavity therebetween configured for receiving a tab therein, the front and back panel portions being affixed to each other on a first side of the cavity near the first edge and on a second side of the cavity opposite from the first side, and the front and back panel portions defining a tab opening in the first side.

32. The device of claim 31, wherein the tab holder comprises a holder panel that is folded over itself to provide the front and back panel portions on each side of a fold, wherein the tab opening is provided along the fold, and the fold comprises the first edge of the first panel.

33. A filing device, comprising:

a first cover panel including a tab holder, the tab holder including a folded over and secured edge portion of the panel forming a cavity, the edge portion having a tab opening extending therethrough and into the cavity, the first cover panel extending to a cover hinge disposed on an opposite side of the first cover panel from the first side;

a second cover panel pivotally connected to the first cover panel at the cover hinge such that the first and second cover panels cooperatively form a folder;

a retractable tab having a display portion and a mounting portion, the mounting portion being mounted in the cavity, and the tab is movable between:

a retracted position in which the display portion is disposed substantially in the cavity, and an extended position in which the display portion extends from the cavity through the tab opening, wherein the tab holder is associated with the mounting portion to retain the mounting portion from being released therefrom, wherein a bottom portion of the display portion includes at least one resiliently deformable protrusion and a width that is greater than a width of the tab opening in a lateral direction such that the retractable tab and the tab opening cooperatively act so as to resiliently deform the at least one protrusion during a sliding movement of the retractable tab between the retracted and extended positions.

34. A filing device, comprising:

a first panel including a tab holder forming a cavity, the edge portion having a tab opening extending therethrough and into the cavity;

a retractable tab having a display portion and a mounting portion, the mounting portion being mounted in the cavity, and the tab is movable between:

a retracted position in which the display portion is disposed substantially in the cavity, and an extended position in which the display portion extends from the cavity through the tab opening, wherein the tab holder is associated with the mounting portion to retain the mounting portion from being released therefrom;

wherein the display portion is resiliently biased out of plane with respect to the mounting portion for bending out of plane with respect to the first panel to resist movement between the extended and retracted positions; wherein the first panel is a file cover panel folded at a first side thereof to form the cavity, and the device further comprises a second cover panel pivotally connected to the first cover panel at a cover hinge disposed on an opposite side of the first panel from the first side, such that the first and second cover panels cooperatively form a file.

35. The filing device of claim 34, wherein the display portion is resiliently biased out of plane with respect to the mounting portion for bending out of plane with respect to the first panel for resisting retraction from the extended position.

36. The filing device of claim 35, wherein the display portion is resiliently biased out of plane for increasing friction against the tab holder in the retracted position that resists movement of the tab toward the extended position.

* * * * *